US005706675A

United States Patent [19]

Manikowski, Jr.

[11] Patent Number: 5,706,675

[45] Date of Patent: Jan. 13, 1998

[54] HIGH EFFICIENCY OXYGEN/AIR SEPARATION SYSTEM

[75] Inventor: Ambrose F. Manikowski, Jr., Cupertino, Calif.

[73] Assignee: G & A Associates, San Jose, Calif.

[21] Appl. No.: 516,554

[22] Filed: Aug. 18, 1995

[51] Int. Cl.[6] ..... F25J 3/04

[52] U.S. Cl. ..... 62/645; 62/903; 62/904; 62/911

[58] Field of Search ..... 62/645, 902, 903, 62/939, 940, 911, 904

[56] References Cited

U.S. PATENT DOCUMENTS

| | | | |
|---|---|---|---|
| 3,861,367 | 1/1975 | Kelmar | 123/119 |
| 4,027,284 | 5/1977 | Gifford | 62/851 |
| 4,224,045 | 9/1980 | Olszewski et al. | 62/939 X |
| 4,631,915 | 12/1986 | Frewer et al. . | |
| 4,729,217 | 3/1988 | Kehlhofer . | |
| 5,080,708 | 1/1992 | Rathbone . | |
| 5,081,845 | 1/1992 | Allam et al. . | |
| 5,251,450 | 10/1993 | Agrawal et al. | 62/939 X |
| 5,268,019 | 12/1993 | Rathbone . | |
| 5,303,556 | 4/1994 | Dray et al. | 62/939 X |
| 5,388,395 | 2/1995 | Scharpf et al. . | |
| 5,404,725 | 4/1995 | Arriulou | 62/939 X |
| 5,406,786 | 4/1995 | Scharpf et al. . | |
| 5,410,869 | 5/1995 | Muller . | |

OTHER PUBLICATIONS

Koros et al., "Membrane–Based Gas Separation", 83 Journal of Membrane Science, pp. 1–31 (Amsterdam, Netherlands 1993).

W.A. Little, "Microminiature Refrigeration", 55 Rev. Sci. Instrum., pp. 661–680 (U.S.A. 1984).

Palmer et al., "ECTAM, A Continuous Combustion Engine . . . ", SAE Technical Paper 950495, presented at the International Congress and Exposition, Detroit, MI, Feb. 27–Mar. 2, 1995, at pp. 73–85.

*Primary Examiner*—Christopher Kilner

*Attorney, Agent, or Firm*—James Creighton Wray

[57] ABSTRACT

A high efficiency oxygen/air separation system uses waste heat produced by an internal combustion engine to produce pure or enriched oxygen for combustion in the internal combustion engine. Nitrogen is eliminated from the combustion process, thus preventing the formation of nitrogen oxides. The formation of other particulates is also reduced as the exhaust gases are repeatedly burned. The separation system includes a manifold heat exchanger, a vane compressor/expander, a spent nitrogen heat exchanger and an insulated container. Air is first compressed in the integrated vane compressor/expander. Compression energy is provided from the expansion of the spent nitrogen after that nitrogen has been heated to exhaust manifold temperatures. High efficiency is achieved through simultaneous expansion and compression. The compressed air is cooled through a spent nitrogen heat exchanger and enters the insulated container, where the oxygen separation takes place. The insulated container includes a regenerative heat exchanger, an expander and a separator column. The compressed air is delivered to the regenerative heat exchanger and is cooled by the separated gas streams that include a mixture of (1) oxygen/argon and (2) nitrogen. The cooled air stream is expanded in the expander where oxygen/argon condenses in the gas stream. The expanded air stream is delivered to a separation column which separates the liquid oxygen/argon mixture from the nitrogen gas by gravity. Nitrogen gas is released and the liquid oxygen/argon mix is returned to the regenerative heat exchanger to cool the incoming compressed air.

22 Claims, 5 Drawing Sheets

HIGH EFFICIENCY OXYGEN/AIR SEPARATION SYSTEM

BACKGROUND OF THE INVENTION

This invention relates to the energy-efficient production of oxygen for use in internal combustion engines and other applications where small scale, high purity oxygen is required.

A large and growing air pollution problem exists in most major cities and metropolitan areas throughout the world. Multiple sources, particularly diesel engines, release pollutants including oxides of nitrogen ($NO_X$) into the atmosphere where the pollutants form a thick layer of orangy-brown air known as smog. While heavy duty vehicles with diesel engines are small in number, those vehicles are responsible for a large percentage of $NO_X$ pollution emanating from mobile sources. At the same time, diesel engines are the most energy efficient power plants available today and are required by the transportation industry to enable continued profitable operations. Needs exist for diesel engine retrofits that reduce $NO_X$ emissions, that are compatible with existing diesel engines, and that do not limit diesel engine efficiency.

Conventional internal combustion engines have prohibitive exhaust emissions for use in most crowded urban environments. Lean burning four stroke automotive engines are available that meet the hydrocarbon and volatile organic compound emissions when burning improved oxygenated or reformulated gasoline. Those improvements, however, have resulted in substantially increased $NO_X$ emissions from those engines. Needs exist for oxygen/air separation systems that cooperate with existing internal combustion engines for pollution emissions without placing excessive parasitic power demands on the host engine.

Commercial separation of air dates back to the turn of the century with the cryogenic distillation of oxygen from air by the Linde process. Most of the world's supply of oxygen today is produced using that process.

In the mid 1960's the technology for perma-selective membrane separation of nitrogen from air became economically viable. The first commercial membrane plants developed in 1977. Since that time, significant time and money has been devoted for the research and development of membranes for combustion air enrichment with oxygen. A principal barrier confronting efforts to use membrane technology for combustion air/oxygen enrichment is the high compression power requirement. Existing membrane oxygen extraction systems require the entire power output of a highly efficient power plant, such as a diesel engine or a fuel cell, to power the compressors for the extraction process. Another issue surrounding the use membrane technology is the oxygen/nitrogen selectivity of the membranes. In a single stage of separation, air is enriched to about 50% oxygen, but the compressor consumes nearly all the power output of most efficient diesel engines. Needs exist for oxygen/air separation systems that require minimal power input from the diesel engines and that provide for high recoveries of pure oxygen.

Modern cryogenic air separation plants produce 3,700 tons of oxygen per day, an amount sufficient to provide high purity oxygen to the combustion process of a 300,000 Hp diesel engine. Those plants are efficient, consuming only 10% of the equivalent oxygen output to drive the power consuming components of the separation plant (i.e., 10% of the oxygen produced by the plant is required to supply pure oxygen to a diesel power plant driving the plant's compressors). Existing technology demonstrates air separation for a 5,000 Hp class diesel engine using turbo expanders for compression and energy recovery. Those separation plants generate 2,500 pounds of pure oxygen per hour to provide oxygen for combustion in an efficient stationary diesel engine in the 5,000 Hp class. Needs exist for highly efficient oxygen/air separation systems that are compatible for use with heavy duty, medium duty and light duty diesel engines requiring only 20 to 100 pounds of oxygen per hour, and for use with fuel cell and hybrid internal combustion/electric power plants requiring less than 20 pounds of oxygen per hour.

Needs exist for highly efficient oxygen/air separation systems that reduce $NO_X$ emissions, reduce other particulate emissions and are easily retrofitted to new or existing engines

SUMMARY OF THE INVENTION

A high efficiency oxygen separation system uses waste heat produced by an internal combustion engine for generating enriched oxygen for combustion in the internal combustion engine. Only enriched or pure oxygen is injected into the engine, thereby eliminating the production of oxides of nitrogen during the combustion process. Since nitrogen never enters the combustion chamber, $NO_X$ cannot be produced. The burned gas fraction, which includes primarily carbon dioxide and water vapor, are the only products of combustion in the present system. The burned gas fraction, which constitutes 80% of the displaced gas volume within the cylinder, becomes the diluent, replacing nitrogen. Particulates, volatile organic compounds and carbon monoxide are significantly reduced in the present invention since the exhaust gases are subjected to combustion or reburned numerous times, as compared to the single combustion processes existing in conventional internal combustion engines. A further advantage of the present invention is its improved thermodynamic efficiency in comparison to that of existing two and four stroke internal combustion engines. Thermodynamic efficiency is enhanced through direct oxygen injection and through the use of pure oxygen in the combustion process, which eliminates induction and exhaust aerodynamic losses associated with nitrogen.

High equivalent oxygen efficiency is achieved in the present invention by using the energy of expansion of air at cryogenic temperatures to compress the spent nitrogen. That process is consistent with the principles of thermodynamics: highest overall cycle efficiencies are attained by compressing gas at the coldest possible temperature. Compressed nitrogen is first heated to an ambient temperature and then to engine manifold temperatures prior to expansion. Using that approach, it is possible to drive the present separation system using waste heat from an internal combustion engine.

The present system incorporates a unique high efficiency vane compressor/expander in both the cryogenic and ambient sections of the system. Those compressors/expanders, coupled with a high efficiency miniaturized regenerative cryogenic heat exchanger, enable scale down of the cryogenic process for use in transportation applications, including heavy duty, medium duty and light duty diesel engine applications requiring only 20 to 100 pounds of oxygen per hour, and applications involving fuel cell and hybrid internal combustion/electric power plants that require less than 20 pounds of oxygen per hour.

The oxygen/air separation system of the present invention supplies pure or enriched oxygen to the combustion process of a diesel engine having a maximum power output of 250 to 450 horsepower and continuous power between 70 and 125 horsepower at 60 miles per hour. The oxygen supply has an average flow rate required for the urban drive cycle, which is approximately ¼ of the maximum continuous rating. The continuous air flow required is 280 to 500 pounds per hour, respectively, yielding 65 to 115 pounds of oxygen per hour, respectively. The $NO_X$ emissions are essentially eliminated since no nitrogen is introduced into the combustion process.

A high efficiency regenerative heat exchanger is used in the present system. One implementation of the heat exchanger uses a spiral configuration that is integrated to serve as heat exchanger passages as well as radiation shields. The main element of the heat exchanger is a spiral of titanium sheet having a groove milled in its center to carry an air tube. Once the air tube is installed, the titanium sheets are stacked and diffusion bonded in a vacuum oven, forming an integrated monolith having a regenerative heat exchanger liquid separation column and a cryogenic expander interface. High pressure air flows through the inside of the air tube. Since the air flow is at a higher pressure than the return nitrogen and oxygen flow, minimal wall thickness is required. The use of air tubes having thin walls minimizes thermal resistance between the higher pressure air and the return oxygen and nitrogen gases.

The present oxygen/air separation system is highly efficient. High efficiency is achieved through:

* Energy recovery using spent nitrogen which is efficiently compressed at cryogenic temperatures and is used to absorb the engine's waste heat. Expansion of the spent nitrogen drives a primary, ambient pressure air compressor, significantly reducing the amount of shaft power required from the engine to power the air compressor.
* A regenerative heat exchanger cools air to cryogenic temperatures, where liquid oxygen and argon are formed. Once liquified, the oxygen gas passes back through the regenerative heat exchanger for recovery of much of the thermal cooling energy which aids in cooling the incoming gas. The regenerative heat exchanger operates at an efficiency greater than 95%, for cryogenic separation of oxygen from air at a scale small enough to serve the requirements of transportation vehicles.
* A vane compressor/expander provides very low friction loss gas compression and energy recovery via gas expansion in an integrated package. Compression and expansion of gases are provided in a single device.

The present invention is useful for transportation and other applications that require high efficiency and clean burning of liquid fuels. The oxygen/air separation system is compatible with high efficiency power systems such as diesel engines and other two stroke and four stroke internal combustion engines. The system offers a clean burning alternative for using available liquid fuels in lieu of natural gas for generating mechanical or electrical power for stationary or mobile applications. The present invention is also well suited for use with hybrid automotive applications. Those vehicles are being developed to achieve a factor of three improvement in fuel economy over existing vehicles. Substantial reduction in size and weight and elimination of $NO_X$ emissions results from the application of this technology with hybrid electric vehicles. Applicable for use with liquid and gaseous fuels, the separation system substantially reduces hydrocarbon and volatile organic compound emissions by retaining burned gases in the combustion chamber for multiple burning cycles.

Operating in conjunction with internal combustion engines in transport vehicles, the present oxygen separation system provides an environmentally acceptable solution to the use of available liquid fuels in highly populated smog-prone regions. The present invention provides a retrofit module that enables either existing or new engines to be retrofitted with a highly efficient compact oxygen/air separation system. Competing economically and environmentally with evolving natural gas conversion systems, the present invention permits conventional internal combustion engines using liquid fuels to achieve significantly lower emissions performance, exceeding the performance of natural gas fueled vehicles, in a reasonably small, energy efficient package.

The oxygen/air separation system of the present invention, when retrofitted to a diesel engine, virtually eliminates $NO_X$ exhaust and greatly reduces carbon monoxide and soot emissions. Retrofitted diesel engines reduce polluting emissions down to substantially cleaner levels that are 100 times less than existing emissions standards for new engines. Importantly, pollution reduction is achieved without resorting to alternative fuels: diesel engines using the present invention continue to use diesel fuel. That advantage allows the present system to be incorporated without any changes to the formulation of diesel fuel or the refueling infrastructure. In addition, the present invention is low cost and maintains, or even slightly improves, engine efficiency. The present system has applications in many vehicles, including but not limited to buses, big rigs, locomotives, automobiles, motorcycles and power plants in ships. Hybrid-electric vehicles having engines configured with the present invention offer an economical approach for ultra low emission vehicles when burning hydrocarbon fuel; zero emission vehicles when burning hydrogen as the fuel.

Advantageous features of the present invention include but are not limited to:

* The use of engine exhaust waste heat to augment the energy efficiency of the compression cycle. Compressed spent nitrogen at 8–10 atmospheres pressure is heated by the engine waste heat to around engine manifold temperatures of around 800 degrees F. The spent nitrogen, when expanded to atmospheric pressure, reduces air compression power requirements by over 90%, thereby reducing the shaft power needed from the engine to drive the oxygen separation process.
* The use of integrated vane compressors/expanders maximize recovery pressure and thermal energy from spent nitrogen. The integrated vane compressors/expanders reduce the friction losses by approximately 50%, as compared to separators that use a separate vane compressor to drive the vane expander. The efficiency of the integrated compression/expansion system exceeds 95% for both compression and expansion.
* The use of a high efficiency regenerative heat exchanger that can be easily mass produced.
* The use of multi-cycle recombustion of burned gas fraction minimizes hydrocarbon and volatile organic compound emissions by having a high exhaust gas recirculation ratio of four to one (parts of combustion gas recycle to exhaust gas). That results in reburning of exhaust gases at least four times and enables significantly lower particulate and hydrocarbon emissions.
* Retrofitting conventional diesel engines with the present system eliminates $NO_X$ emissions and significantly reduces particulate emissions and volatile organic compounds. Minimal modifications are needed to retrofit the engine, those changes including the addition of a high exhaust recirculation system, the addition of a system to fumigate the gas induction system with oxygen, the addition of an exhaust manifold heat exchanger for waste heat recovery and the installation of the oxygen/air separation system.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
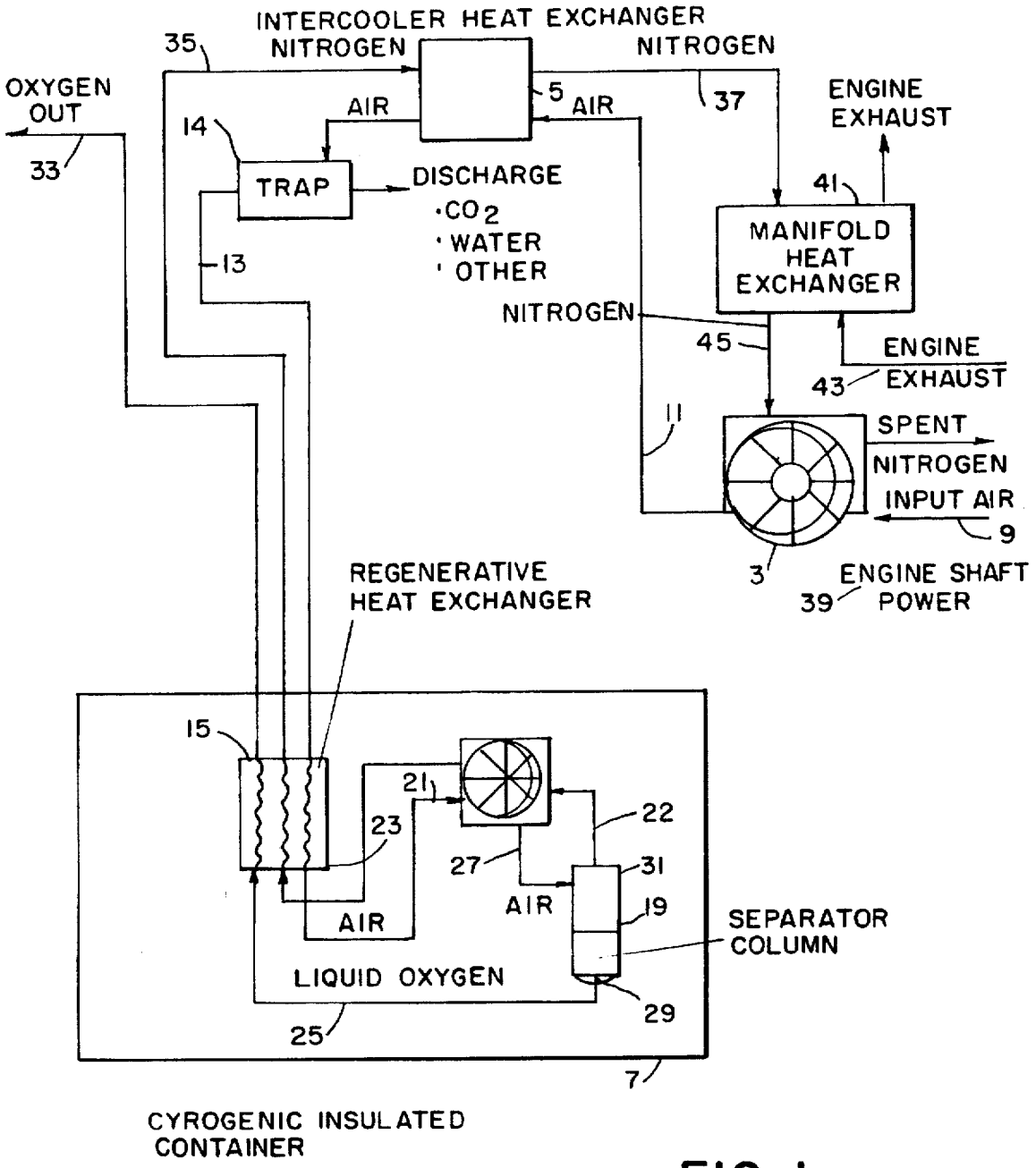
FIG. 1 is a schematic illustration of the oxygen/air separation system of the present invention.

Referring to FIG. 1, an oxygen/air separation system 1 includes a first compressor/expander 3, a first heat exchanger 5, and an insulated container 7. Input air 9 is first compressed in the integrated compressor/expander 3. The compressed air 11 exits the first compressor/expander 3 and enters the first heat exchanger 5, where the compressed stream 11 of air is cooled. The compressed, cool stream 13 of air next enters the insulated container 7, or cold box, where the air stream 13 is separated. As shown in FIG. 1, a trap 14 for water, carbon dioxide and other foreign material can be positioned in the air line 13 between the heat exchanger 5 and the insulated container 7.

The insulated container 7 separates oxygen from nitrogen. Expansion to cryogenic temperatures takes place within the insulated container 7, where the oxygen is liquified. A preferred embodiment of the container 7, as shown in FIG. 1, includes a regenerative heat exchanger 15, a second integrated compressor/expander 17 and a separator column 19. The compressed, cool stream 13 of air enters the regenerative heat exchanger 15 where the stream 13 is cooled, creating a cryogenic air stream 21. The air stream 13 is cooled by the separated nitrogen stream 23 and separated oxygen stream 25. The cryogenic air stream 21 is expanded in the second integrated compressor/expander 17, where the oxygen begins to condense. The expanded cryogenic air stream 27 is then delivered to a separator column 19, where the liquid oxygen/argon mixture is separated from the nitrogen gas by gravity. The liquid fractions 29 including the purified oxygen are drained from the bottom of the column 19. The gaseous nitrogen 31 is released from the top of the column 19. The liquid fractions 29 and the nitrogen gas 31 are returned, via different channels, to the regenerative heat exchanger 15, where the separated liquid oxygen stream 25 and separated nitrogen gas stream 23 are used to cool the incoming air 13 to cryogenic temperatures. Prior to reaching the regenerative heat exchanger 15, the nitrogen stream 23 is compressed in the second integrated compressor/expander 17. The purified oxygen/argon mixture 33 exits the insulated container 7 and can be delivered to an engine for combustion. The nitrogen gas stream 35 exits the insulated container 7 and returns to the first heat exchanger 5, where the nitrogen gas stream 35 is used to cool the compressed air 11 from the first integrated compressor/expander 3 as the compressed air 11 passes through the first heat exchanger 5. The nitrogen gas stream 37 passes over the diesel exhaust manifold heat exchanger where the temperature is raised to near exhaust manifold temperature. Following the manifold heat exchanger the nitrogen stream 37 flows to the first integrated compressor/expander 3, where the nitrogen stream 37 is expanded as input air 9 is compressed.

The first and second integrated compressors/expanders 3, 17 greatly enhance the efficiency of the present invention by recovery of waste heat from engine exhaust gases. Preferably, the first and second integrated compressors/expanders 3, 17 are integrated vane compressors/expanders. A significant fraction, in excess of 90%, of the compression energy is derived from the expansion of the gases. In the first integrated compressor/expander 3, the compression energy is derived from expansion of spent nitrogen after the nitrogen has been heated in the exhaust manifold heat exchanger. In the second integrated compressor/expander 17, the compression energy for repressurizing the spent nitrogen is derived from expansion of the cryogenic air stream 21 after the air stream has been cooled in the regenerative heat exchanger 15. Preferably, the expansion and compression processes occur simultaneously in the integrated devices 3, 17. Simultaneous expansion and compression enable the very high process efficiency required to achieve the scale appropriate for transportation applications.

As shown in FIG. 1, shaft power 39 drawn from an engine can be used to supplement the compression of incoming air 9. In preferred embodiments, some supplemental shaft power may be necessary, as nearly all the power requirements necessary to drive the oxygen separation process are provided by compression and expansion of the component gases of air.

As shown in the embodiment of the present system shown in FIG. 1, a manifold heat exchanger 41 is positioned between the first heat exchanger 5 and the first integrated compressor/expander 3. The compressed, heated nitrogen gas stream 37 exits the first heat exchanger 5 and enters the manifold heat exchanger 41. The nitrogen gas stream 37 is heated further to engine manifold temperatures by high temperature exhaust 43. The hot nitrogen gas stream 45 passes to the first integrated compressor/expander 3 and is expanded, providing nearly all the work needed to compress the ambient input air 9.

In a preferred embodiment of the present invention, input air 9 enters the first integrated compressor/expander 3, where the air 9 is compressed to about 20 atmospheres. The compressed air 11 is cooled in a first heat exchanger 5 to a temperature of about 300° K. The compressed, cooled air 13 enters the insulated container 7 and is cooled further in a regenerative heat exchanger 15 to a cryogenic temperature of about 120° K at 21. The cryogenic air stream 21 is expanded in the second integrated compressor/expander 17 to about 5 atmospheres and 100° K at 17. Once separated, the liquid oxygen 25 and nitrogen gas streams 23 are returned to the regenerative heat exchanger 15, where the separated liquid oxygen 25 is heated to a gas at about 290° K, as is the nitrogen gas stream 23. Prior to re-entering the regenerative heat exchanger 15, the separated nitrogen gas stream 22 is compressed to about 8–10 atmospheres. The oxygen stream 33 exits the container 7 at a pressure of about 5 atmospheres and at a temperature of about 290° K. Once the nitrogen gas stream 35 exits the container 7, the stream 35 is heated in the first heat exchanger 5 to about 600° K, thereby facilitating the cooling of the compressed air 11. The nitrogen stream 37 is heated again to a manifold temperature of about 780° K. The hot nitrogen stream 45 is then expanded to a pressure of 1 atmosphere, driving the compression of the input air 9 using energy of expansion.

Figure 2:
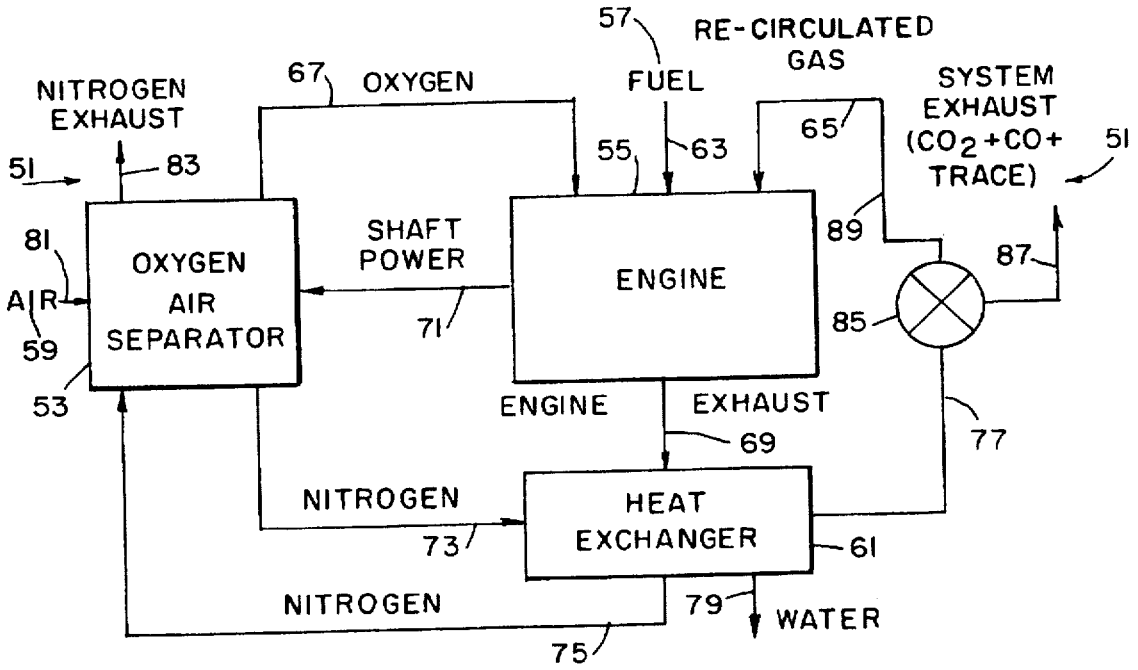
FIG. 2 is a schematic illustration of the oxygen/air separation system of the present invention operating in conjunction with an internal combustion engine.

As shown in FIG. 2, the present oxygen/air separation system, in combination with an internal combustion engine, makes use of waste heat produced by the engine to produce nearly pure oxygen for combustion in the internal combustion engine. The operational system 51 includes the oxygen/air separation system 53, an engine 55, a fuel source 57, an air source 59 and a heat exchanger 61. The engine 55 receives fuel 63 from the fuel source 57, recirculated gas 65 from the heat exchanger 61, and purified oxygen 67 from the oxygen/air separator 53. The engine 55 delivers engine exhaust 69 to the heat exchanger 61 and shaft power 71 to the oxygen/air separator 53. The heat exchanger 61, preferably a manifold heat exchanger, receives the engine exhaust 69 from the engine 55 and compressed spent nitrogen 73 from the oxygen/air separator 53. The heat exchanger 61 delivers high temperature nitrogen 75 to the oxygen/air separator 53 and burned gas fractions 77 to the engine 55 and releases water 79. The oxygen/air separator 53 receives the high temperature nitrogen 75 from the heat exchanger 61, air 81 from the air source 59, and shaft power 71 from the engine 55, delivers the purified oxygen 67 to the engine 55, and releases nitrogen exhaust 83. Embodiments of the separation system, such as the system shown in FIG. 1, serve as the oxygen/air separator 53. The manifold heat exchanger 41 in FIG. 1 is the heat exchanger 61 in FIG. 2.

As shown in FIG. 2, nitrogen is completely eliminated from the combustion process. The burned gas fraction 77 exiting the heat exchanger 61 includes primarily carbon dioxide and water vapor. Those are the only primary products of combustion when an internal combustion engine is used in conjunction with the present oxygen/air separation system. The burned gas fraction 77, less the water condensate 79, travels through a divider 85 which releases a first percentage of the burned gas fraction 77 as system exhaust 87 and delivers the remaining burned gas fraction 89 back to the engine 55 as re-circulated gas 65 for further combustion. In a preferred embodiment, the divider 85 releases about 20% of the burned gas fraction as exhaust 87 and recirculates about 80% of the burned gas fraction back to the engine for further combustion. That results in the reburning of burned gas fractions at least four times, thereby providing for significantly lower particulate and hydrocarbon emissions.

Figure 6:
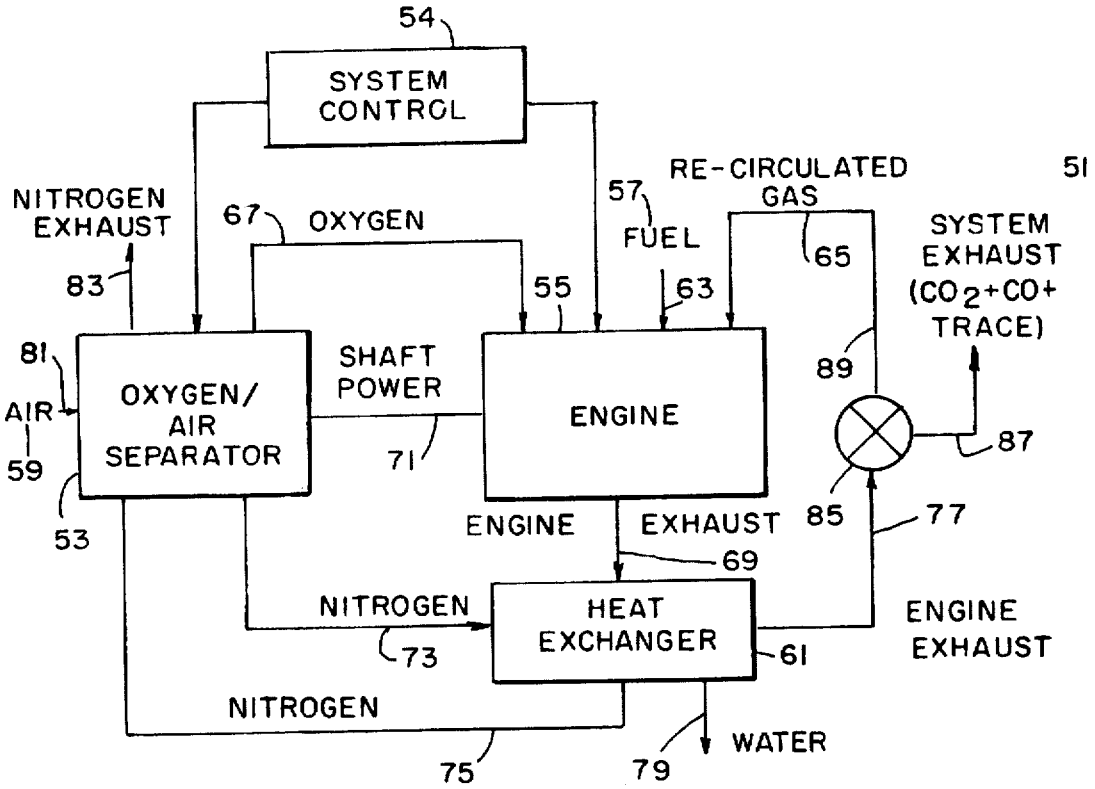
FIG. 6 is a schematic illustration of the oxygen/air separation system of the present invention operating in conjunction with an internal combustion engine and having a system control between the oxygen/air separation system and the engine.

As shown in FIG. 6, a system control 54 can be positioned between the oxygen/air separator 53 and the engine 55. The overall system control 54 monitors various functions within the oxygen/air separator 53 and interfaces with the control of the engine 55. As shown in FIG. 8, the path of information and data travel is bidirectional.

Figure 3A:
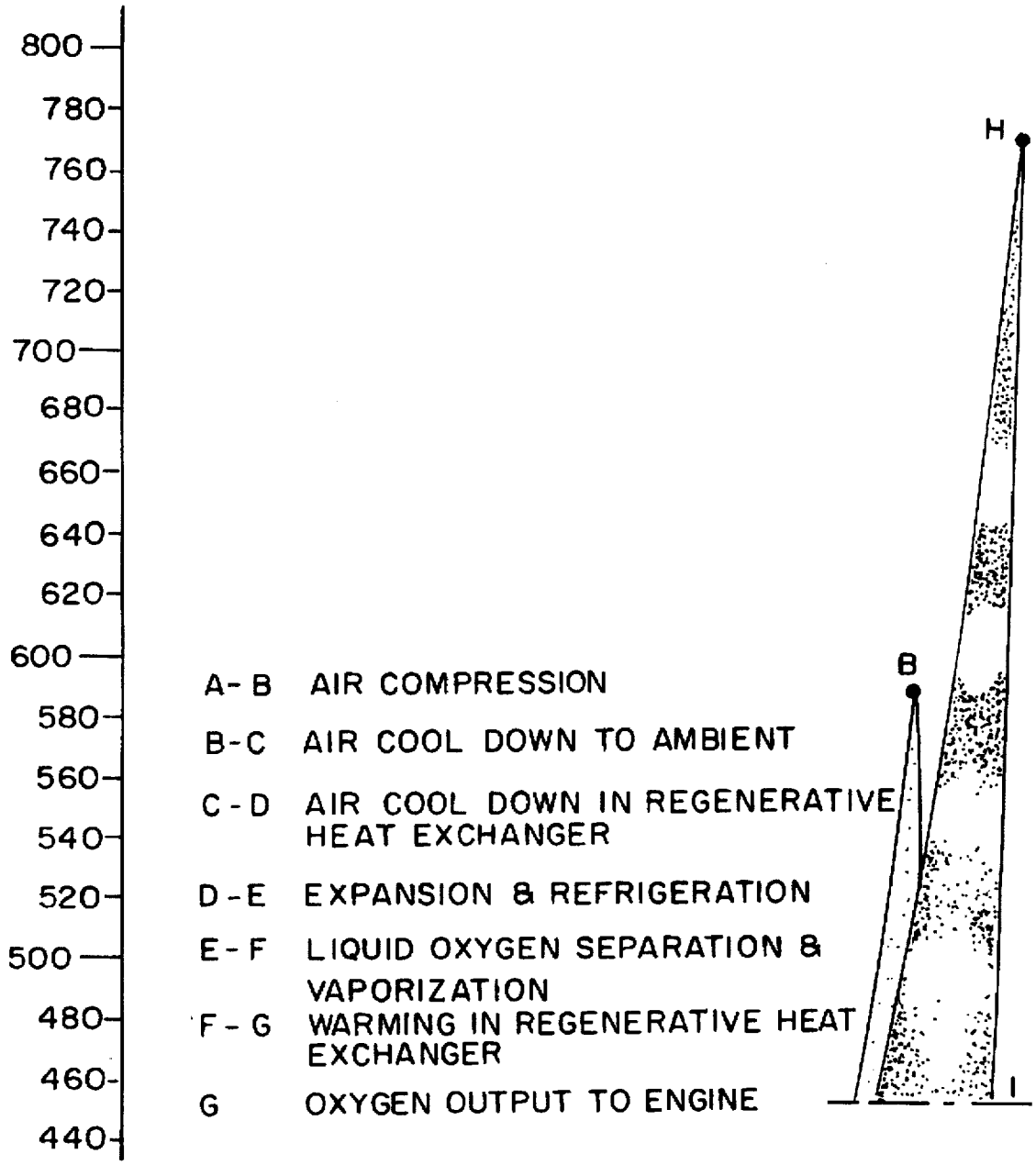
FIG. 3 shows an embodiment of the high efficiency regenerative heat exchanger positioned around a central separation column, the regenerative heat exchanger having a spiral sheet with grooves and air tubes.
Figure 3B:
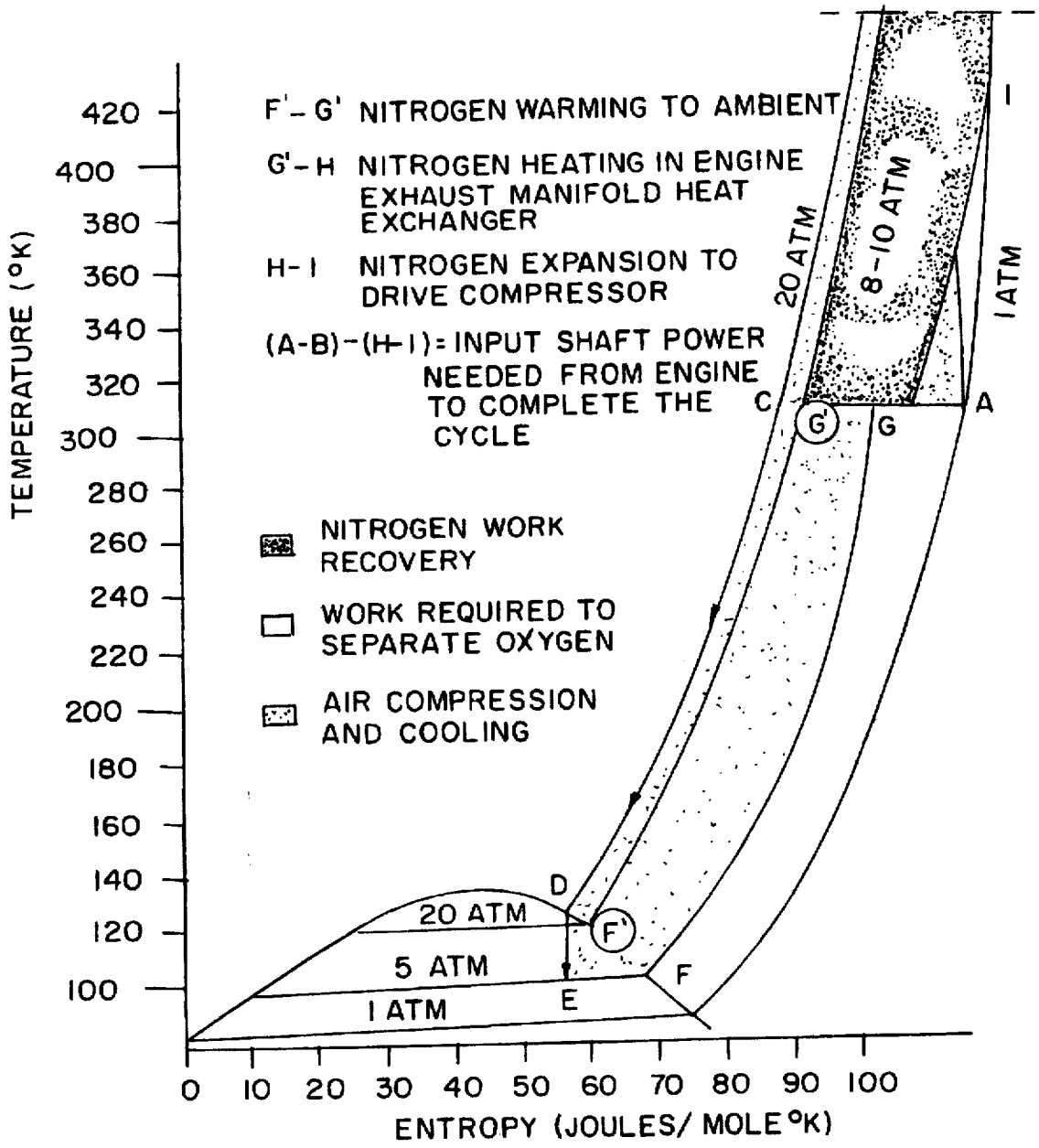

FIG. 3 is a thermodynamic diagram of the refrigeration process of the present oxygen/air separation system. The letters designate the cycle states of operation. Polytropic compression of the air from ambient pressure to about 20 atmospheres occurs from A to B. From B to C, the compressed air is cooled in an air intercooler regenerative heat exchanger. At D, the cold, compressed air is delivered to the second integrated compressor/expander. Expansion of the air, along with condensation of oxygen, occurs from D to E. At E, the expanded air stream including the condensed oxygen is delivered to the separator. In preferred embodiments, the separator is a gravity separator column. At E, the liquid oxygen drops to the bottom of the separator and the nitrogen gas rises to the top of the separator. The separated cryogenic nitrogen and oxygen streams are returned to the regenerative heat exchanger at E. The separated cryogenic nitrogen and oxygen streams provide the heat sink for cryogenically cooling the incoming air. From F' to G' for nitrogen and from F to G for oxygen, the streams are warmed in the regenerative heat exchanger. At G, the purified oxygen stream, which includes argon, exits the regenerative heat exchanger and the insulated container. Preferably, the oxygen stream exits the insulated container at 5 atmospheres and slightly below ambient temperature (about 290° K). The nitrogen stream also exits the insulated container at about this temperature and at about 8–10 atmospheres pressure. The magnitude of temperature change, delta T, is related to the regenerative heat exchanger efficiency. The exited nitrogen stream is heated to ambient temperatures at G', and continues heating to 600° K in the air heat exchanger, and then to manifold temperature at H, about 780° K. Nitrogen expansion occurs between H and I, that expansion providing most of the energy needed to drive the air separation process. The enthalpy difference between the separated gases and the incoming air is the amount of refrigeration that must be provided by the expansion process from C to D. Expanding from 20 to 5 atmospheres provides 28 kJ/kg of cooling, and requires a regenerative heat exchanger with an efficiency greater than 95%.

Figure 4:
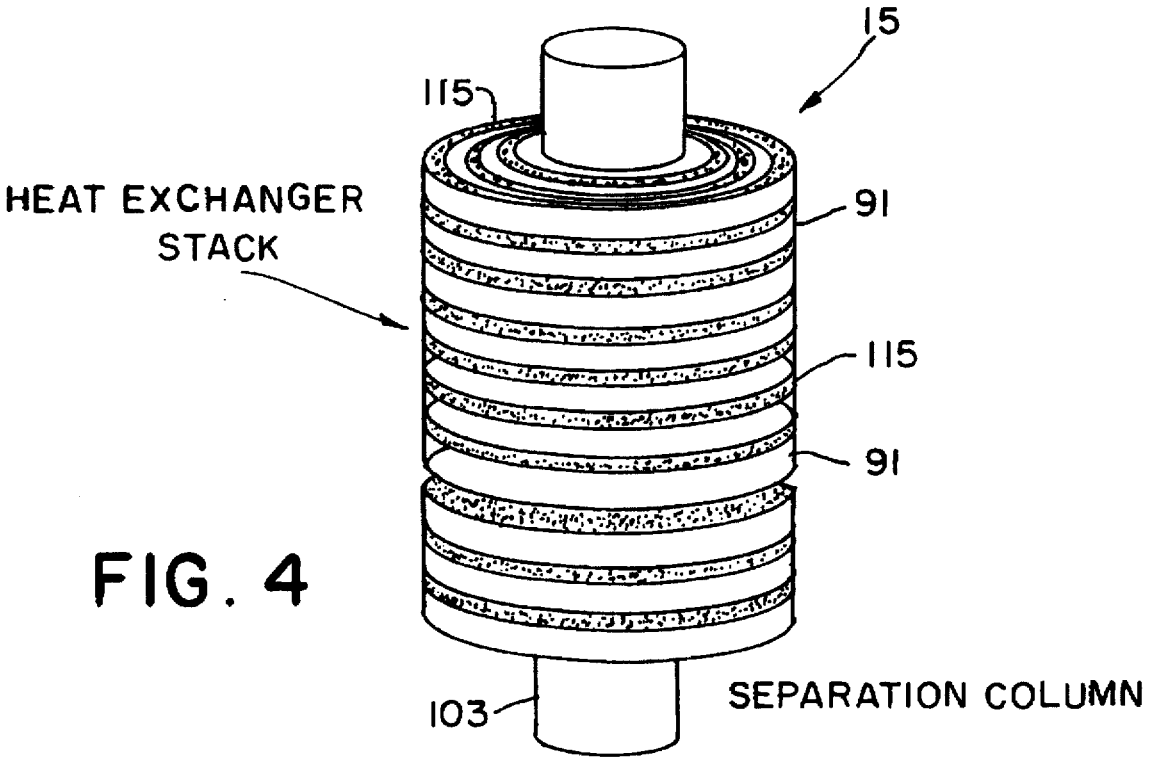
FIG. 4 is a detail of the high efficiency regenerative heat exchanger shown in FIG. 3.
Figure 5:
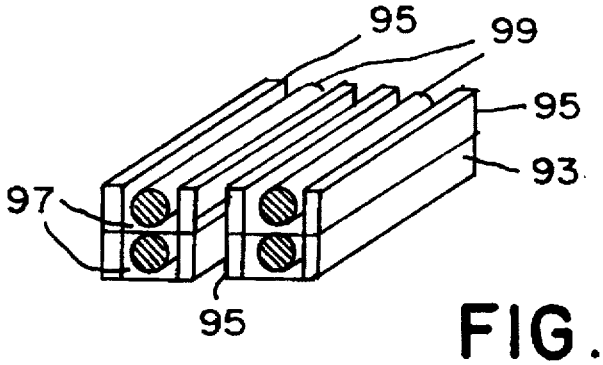
FIG. 5 is a temperature/entropy diagram for the air circulated in the present invention.

FIGS. 4 and 5 show a preferred embodiment of a high efficiency regenerative heat exchanger 15 that is compatible for use in the present invention. The heat exchanger 15 includes multiple plates 91, with each plate 91 having a spiral groove. Each plate 91 is fabricated in a spiral configuration and has a groove to accommodate a tube. The metal sheet 93 has side walls 95 and a groove 97 extending between the side walls 95. A tube 99 for carrying air is positioned in the groove 97 of each plate 91 and follows the spiral of the sheet 93. Preferably, the tube 99 is a thin walled tube made of aluminum, stainless steel or titanium. Multilayer boundaries or shields 101 are positioned between the spirals of each plate. Those areas serve as heat passages and radiation shields. The plates 91 are stacked and connected to form the heat exchanger 15.

Each spiralled metal sheet 93 accepts and holds an air tube 99. Next, the plates 91 are stacked for bonding. Preferably, the plate stack is diffusion bonded in a vacuum oven, forming an integrated monolith. In preferred embodiments, the liquid separation column 103 is positioned in the center of the regenerative heat exchanger 15, creating a separation column/cryogenic expander interface. Air travels in the tube 99 toward the separation column 103 from the outside edge 105 of the heat exchanger 15. The separated oxygen and nitrogen streams travel in the spiral sheets 93 outward from the separation column 103 and towards the outer edge 105 of the heat exchanger 15, surrounding the tubes 99. Since the air flow in the tubes 99 are at a higher pressure than the return nitrogen and oxygen flow, minimal tube wall thickness is required. That allows for the minimization of thermal resistance between the higher pressure air traveling through the tubes and the return separated oxygen and nitrogen gas streams.

While the invention has been described with reference to specific embodiments, modifications and variations of the invention may be constructed without departing from the scope of the invention, which is defined in the following claims.

I claim:

1. An oxygen/air separation apparatus comprising a first compressor/expander, a first heat exchanger, a manifold heat exchanger and an insulated container, wherein the first compressor/expander compresses input air and expands high pressure, high temperature spent nitrogen from the manifold heat exchanger, wherein the first heat exchanger cools the compressed input air from the first compressor/expander and heats high pressure nitrogen from the insulated container, wherein the manifold heat exchanger heats the heated high pressure nitrogen from the first heat exchanger and cools engine exhaust, further comprising a second heat exchanger provided in the insulated container for further cooling the cooled, compressed input air from the first heat exchanger, a separator in the insulated container for separating the further cooled compressed input air into oxygen and nitrogen, and a second compressor in the insulated container for compressing the nitrogen to obtain said high pressure nitrogen.

2. The apparatus of claim 1, wherein the second heat exchanger is a regenerative heat exchanger, the second compressor is a second compressor/expander and the separator is a separator column, wherein the regenerative heat exchanger cools the cooled, compressed input air from the first heat exchanger, heats the liquified oxygen, and heats the high pressure nitrogen, wherein the second compressor/expander expands the cooled, compressed air from regenerative heat exchanger and compresses the separated nitrogen, and wherein the separator column separates the cooled, expanded air from the second compressor/expander into nitrogen and liquid oxygen components.

3. The apparatus of claim 2, wherein the regenerative heat exchanger has a spiral configuration that spirals around the separator column, the exchanger further comprising multiple sheets stacked and bonded together, each sheet having side walls and a groove milled between the side walls, the sheet spiralled such that small passages are formed between the walls of adjacent sections of the sheet as the sheet is spiralled, and an air tube positioned in the groove of the sheet between the side walls for carrying high pressure air.

4. The apparatus of claim 3, wherein the sheet is made of titanium, and wherein the tube is made of a material selected from the group consisting of titanium, stainless steel and aluminum.

5. The apparatus of claim 1, further comprising a power source connected to the first compressor/expander for supplementing the compression of the input air.

6. The apparatus of claim 2, further comprising a power source connected to the second compressor/expander for supplementing the compression of the nitrogen stream.

7. An insulated container for separating oxygen from air comprising a regenerative heat exchanger, a compressor/expander and a separator column, wherein the regenerative heat exchanger cools compressed input air, heats liquified oxygen from the separator column, and heats high pressure nitrogen from the compressor/expander, wherein the compressor/expander expands the cooled, compressed air from regenerative heat exchanger and compresses separated nitrogen from the separator column, and wherein the separator column separates the cooled, expanded air from the compressor/expander into nitrogen gas and liquid oxygen components.

8. The apparatus of claim 7, wherein the regenerative heat exchanger has a spiral configuration that spirals around the separator column, the exchanger further comprising multiple sheets stacked and bonded together, each sheet having side walls and a groove milled between the side walls, the sheet spiralled such that small passages are formed between the walls of adjacent sections of the sheet as the sheet is spiralled, and an air tube positioned in the groove of the sheet between the side walls for carrying high pressure air.

9. The apparatus of claim 1, further comprising a trap positioned after the first heat exchanger and prior to the insulated container for trapping water, carbon dioxide and other foreign material present in the cooled, compressed input air from the first heat exchanger.

10. A method for separating oxygen from air comprising the steps of inputting air to a compressor/expander, compressing the input air, cooling the compressed air from the compressor/expander in a heat exchanger, introducing the cooled air from the heat exchanger into an insulated container, separating oxygen from the air introduced into the container, releasing purified oxygen from the container, recycling warm nitrogen gas out from the insulated container, heating the warm nitrogen outside of the insulated container, expanding the heated nitrogen in the compressor/expander, and releasing the spent nitrogen.

11. The method of claim 10, wherein the step of heating the spent nitrogen outside of the insulated container further comprises running the warm nitrogen through the heat exchanger through which the compressed air from the compressor/expander is cooled.

12. The method of claim 10, further comprising the step of heating the heated nitrogen in a manifold heat exchanger prior to expanding the heated nitrogen.

13. The method of claim 12, wherein the step of heating the heated nitrogen in a manifold heat exchanger further comprises running a stream of exhaust through the manifold heat exchanger and cooling the exhaust.

14. The method of claim 12, further comprising applying a ceramic coating to a diesel engine combustion chamber for increasing a combustion temperature capability of the engine, thereby yielding two-fold improvements in thermal efficiency of the diesel engine and power out derived from expansion of spent nitrogen in the oxygen separator cycle, essentially eliminating a need to extract shaft power from the engine to drive the oxygen/air separation.

15. The method of claim 10, wherein the step of separating oxygen from the air introduced into the container further comprises cooling the introduced air in a regenerative heat exchanger, expanding the cooled air from the regenerative heat exchanger, separating liquid oxygen from nitrogen gas in the expanded air using a separator column, draining the liquid oxygen from the separator, heating the liquid oxygen from the separator in the regenerative heat expander, forming the purified oxygen, compressing the separated nitrogen gas, and heating the compressed nitrogen gas in the regenerative heat exchanger, forming warm nitrogen gas.

16. The method of claim 15, wherein the steps of compressing separated nitrogen gas and expanding the cooled air from the regenerative heat exchanger are simultaneously performed using an integrated compressor/expander such that the energy of expansion drives the compression.

17. The method of claim 10, further comprising trapping water, carbon dioxide or other foreign materials present in the cooled air delivered from the first heat exchanger prior to the introducing of the cooled air into the insulated container.

18. A method for separating oxygen from air comprising the steps of inputting air into an integrated compressor/ expander, compressing the air to about 20 atmospheres, cooling the compressed air in a first heat exchanger to a temperature of about 300° K, introducing the cooled air from a first heat exchanger into an insulated container, separating the oxygen from the air in the container, releasing separated oxygen gas from the insulated container at about 5 atmospheres and about 290° K, releasing separated nitrogen gas from the insulated container at about 8–10 atmospheres and about 290° K, heating the nitrogen gas in the first heat exchanger to about 600° K, thereby facilitating the cooling of the compressed air, heating the nitrogen gas from the first heat exchanger in a second heat exchanger to 780° K, expanding the heated nitrogen gas from the second heat exchanger to a pressure of 1 atmosphere, and driving the compressing of the input air using energy of expansion.

19. The method of claim 18, wherein the step of separating the oxygen from the air in the container further comprises cooling the introduced air in a regenerative heat exchanger to a cryogenic temperature of about 120° K, compressing the cooled air from the regenerative heat exchanger to about 5 atmospheres, separating the air in a separator column such that liquid oxygen falls to a bottom of the separator column and nitrogen gas rests at a top of the separator column, heating the separated liquid oxygen to a gas at 410° R, compressing the nitrogen gas to about 13 atmospheres, and heating the compressed nitrogen gas in the regenerative heat exchanger to about 410° R.

20. The method of claim 19, wherein compressing the separated nitrogen gas and expanding the cooled air from the regenerative heat exchanger are simultaneously performed using an integrated compressor/expander such that the energy of expansion drives the compression.

21. The method of claim 19, wherein the step of compressing input air further comprises expanding the heated nitrogen from the second heat exchanger and driving compression of the input air using energy from expansion, the expanding and compressing being simultaneous steps performed using an integrated compressor/expander.

22. The method of claim 21, further comprising transferring shaft power from an engine to the compressor/expander for providing further power for compression.

* * * * *